US006644836B1

(12) United States Patent
Adams

(10) Patent No.: US 6,644,836 B1
(45) Date of Patent: Nov. 11, 2003

(54) APPARATUS FOR HANGING ROPE LIGHTS FROM A GUTTER

(75) Inventor: William E. Adams, Portersville, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 10/128,199

(22) Filed: Apr. 23, 2002

(51) Int. Cl.[7] ..... F21V 21/00

(52) U.S. Cl. ..... 362/396; 362/145; 362/147; 362/152; 362/249; 362/250; 362/252; 362/287

(58) Field of Search ..... 362/145, 396, 362/147, 152, 249, 250, 252, 287, 285, 391, 806; 248/65, 73, 74.2, 48.1, 300, 301, 304, 48.2, 239

(56) References Cited

U.S. PATENT DOCUMENTS

| | | | | |
|---|---|---|---|---|
| 3,599,916 A | * | 8/1971 | Szabo | 248/73 |
| 5,141,192 A | * | 8/1992 | Adams | 248/231.81 |
| D331,360 S | | 12/1992 | Adams | |
| D368,219 S | | 3/1996 | Protz, Jr. | |
| 5,496,005 A | | 3/1996 | Dieringer | |
| 5,566,058 A | | 10/1996 | Protz, Jr. | |
| 5,607,230 A | | 3/1997 | Protz, Jr. | |
| 5,609,415 A | * | 3/1997 | Protz, Jr. | 362/396 |
| D385,776 S | | 11/1997 | Protz, Jr. | |
| 5,921,511 A | | 7/1999 | LaPointe | |
| 6,076,938 A | | 6/2000 | Kinderman | |
| 6,109,765 A | | 8/2000 | Blanton | |
| D432,905 S | | 10/2000 | Sutker et al. | |
| 6,155,526 A | | 12/2000 | Brown | |
| 6,328,459 B1 | | 12/2001 | Adams | |
| 6,352,291 B1 | | 3/2002 | Tortajada | |

* cited by examiner

*Primary Examiner*—Sandra O'Shea
*Assistant Examiner*— Tsidulko
(74) *Attorney, Agent, or Firm*—Buchanan Ingersoll, P.C.

(57) ABSTRACT

The invention relates to an apparatus for hanging rope lights on a gutter. The light holder has a spiral that fits over the lip of a gutter and a hook at an opposite end sized to receive a rope light. The body is shaped so that the hook is opposite a curved portion of the front wall of the gutter, at the intersection of the front wall and the bottom of the gutter or below the bottom of the gutter. Curved sections may be provided on the body between the hook and the spiral to receive additional rope lights. A hook may be provided to mount rope lights above the top lip of the gutter or adjacent the flat portion at the top of the gutter.

39 Claims, 9 Drawing Sheets

APPARATUS FOR HANGING ROPE LIGHTS FROM A GUTTER

BACKGROUND OF THE INVENTION

1. Field of the Invention

The present invention relates to a device for hanging decorative lights, particularly rope lights from a gutter.

2. Description of the Prior Art

Many people decorate their homes with strings of decorative lights during holiday seasons, particularly during the Christmas season. Lights can be mounted on the exterior of a house or commercial building in many ways. A large number of hooks and hangers for cords, wires, and especially Christmas lights have been proposed in the past. Many of these hooks are removable. Others are utilized for hanging Christmas lights that contemplate a permanent addition of part or all of the device to the house itself. Examples of these permanent or semi-permanent installations are: Trueson, U.S. Pat. No. 3,189,310, Kvarda, U.S. Pat. No. 3,204,090, Van Ess, U.S. Pat. No. 4,244,014, Campbell, U.S. Pat. No. 3,275,818, and Cuva, U.S. Pat. No. 3,540,687, which all disclose various methods for mounting Christmas lights on a wire to a house. Each of the above patents requires some permanent or semi-permanent modification of the house itself, by affixing all or a portion of the device to the house. The use of these devices is time consuming and laborious, and removal is equally complicated.

Removable hooks have several important aspects, primarily ease of use and removal, combined with stability during attachment to the gutter. The use of curved or shaped hooks, both for Christmas lights and other cord fastening, is well known. A number of devices, exemplified by Bailey, U.S. Design Pat. No. 34,263, Worley, et. al., U.S. Pat. No. 1,866,691, Parton, U.S. Design Pat. No. 272,887, and Kinghorn, U.S. Pat. No. 3,011,049, are generally useful for this purpose. None of the devices, however, are particularly adaptable for use on a gutter.

In my U.S. Pat. Nos. 5,141,192 and Des 331,360 disclose hooks that are particularly useful for hanging strings of decorative lights from gutters. These light holders have a ribbon-shaped body with a hook at one end of the device. The hook end is designed to retain a wire or cord portion of a string of Christmas lights, not a light socket, and is generally sized so as to accommodate at least one cord. The second end of the device has a spiral curvature with a proximal point adjacent to the body, the spiral end forming a curve whereby the spiral continues beyond the proximal point. The device is thus adapted to fit over a portion of a gutter lip. That lip is positioned between the proximal point of the spiral and the body. The device has sufficient size, shape and resilience to enable the spiral end to grip the gutter lip. The spiral end solved the primary problem with mounting a clamp or hook on a gutter. The trough of most gutters extends in a curved manner upwardly, with a boxed shaped lip having a right angle at the termination point. This peculiar shape of most gutter lips will not accommodate most C-shaped and S-shaped hooks and those that do fit over that lip are easily dislodged. The spiral extends from the underside of the lip to the exterior surface of the gutter to provide a secure attachment. The central body of this gutter hook extends straight downward from the spiral while the adjacent wall of the gutter curves inward. Consequently, the light string being held by the hook at the lower end of the body is spaced some distance away from the exterior surface of the gutter. For this reason a string of lights hung on these hooks is easily seen during daylight.

In recent years rope lights have become quite popular. These lights are a long plastic translucent or transparent tube containing spaced apart mini-lights. Depending upon the spacing of the lights such a light string may when lit appear to be a solid line of light or distinct, spaced apart points of light. Many clips known in the art for holding strings of decorative lights including the gutter hook disclosed in my U.S. Pat. No. 5,141,192 can also hold rope lights.

While most people put up holiday lights at the beginning of the season and take them down during the end of the season, many people would prefer to simply leave them in place throughout the year. While a few people do in fact leave holiday lights mounted on their house or commercial building year round, most people do not do this. Perhaps the primary reason that they take their lights down at the end of the season is that the lights are quite noticeable during daylight hours. Some people may also believe that exposure to weather and sunlight over the course of a year may cause damage to or shorten the life of the light strings. This concern may be particularly true for rope lights whose plastic sheath may deteriorate as a result of prolonged exposure to sunlight. Consequently, there is a need for a device that will mount rope lights in a manner that they can be kept up all year without being easily noticed and reduce or eliminate damage from prolonged exposure to sunlight.

SUMMARY OF THE INVENTION

A device is provided for mounting rope lights on a gutter has a ribbon-shaped body member having a spiral at one end. The body is contoured to match the shape of the front of a gutter and may be sized to extend from the lip at the top of the gutter to under the bottom of the gutter, or extend to any point between the top and the bottom of the gutter. There is a hook at the opposite end of the body that is sized to receive a rope light. There may also be curved portions along the body that are sized to hold the rope light against the front surface of the gutter. These curved portions are positioned to correspond to oppositely curved portions of the front face of the gutter. Consequently, the rope lights will be nested in a curve of the gutter or against the underside of the bottom of the gutter, thereby shielding the rope light from sunlight during much of the day. Placing a rope light in a concave curve of the gutter also increases the light reflected to the viewer in front of the house, allowing smaller less expensive lights to be used. Saving both initial cost and electricity during use. Preferably, the body is made of a clear, resilient plastic such as polycarbonate. A hook may be provided to mount rope lights above the top lip of the gutter or adjacent the flat portion at the top of the gutter. A hook may be provided to mount rope lights above the top lip of the gutter or adjacent the flat portion at the top of the gutter.

These and other advantages and features of the present invention will be more fully understood on reference to the presently preferred embodiments thereof and to the appended drawings.

DESCRIPTION OF THE PREFERRED EMBODIMENTS

Figure 1:
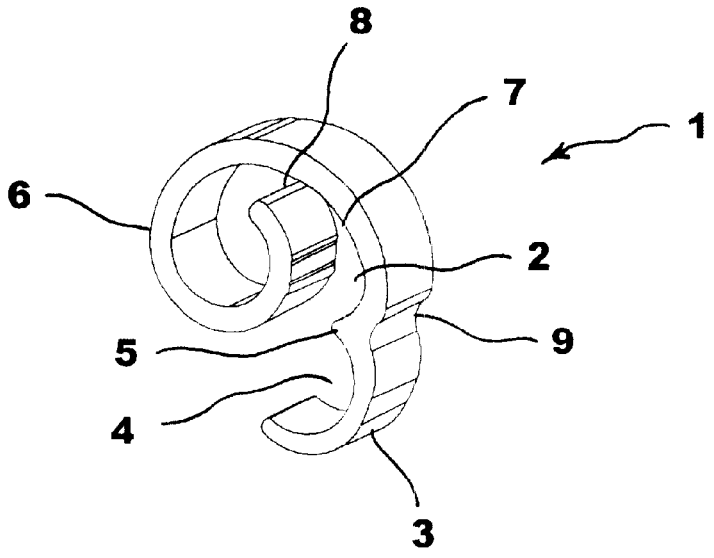
FIG. 1 is an perspective view of a first present preferred embodiment of my apparatus for hanging rope lights on a gutter.
Figure 4:
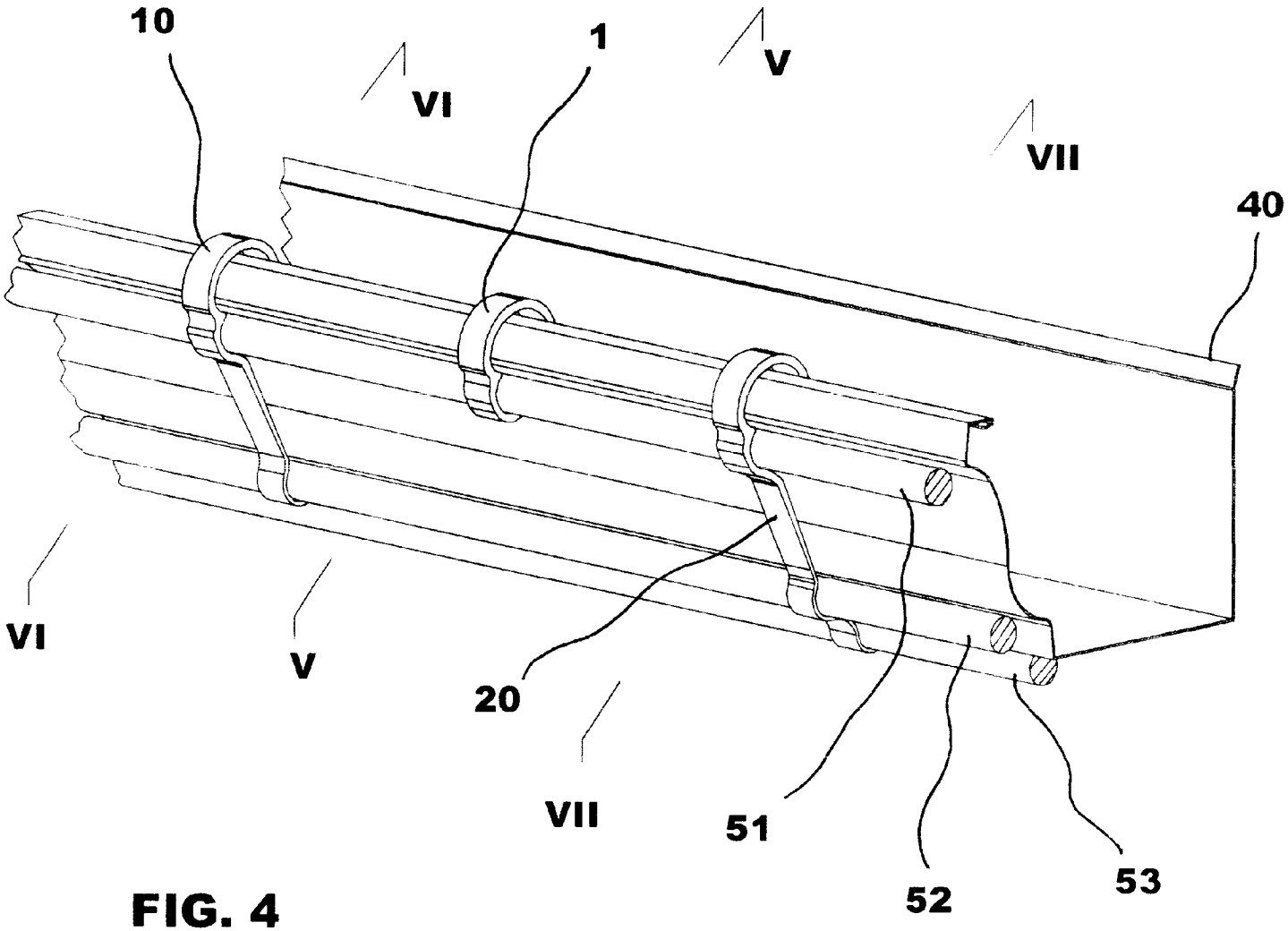
FIG. 4 is a perspective view of a portion of a gutter on which rope lights are being hung by one of each of the embodiments shown in FIGS. 1 through 3.
Figure 5:
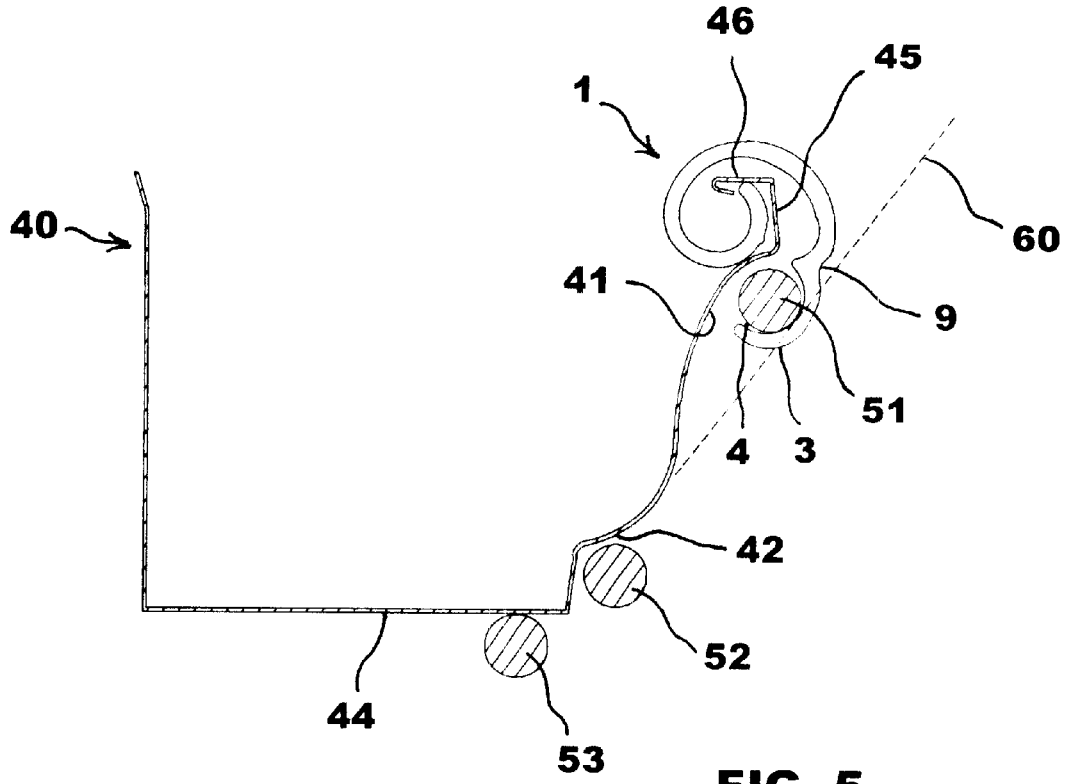
FIG. 5 is a sectional view taken along the line V—V in FIG. 4.

A first present preferred embodiment of my apparatus for hanging rope lights on a gutter shown in FIG. 1 has a flat body member 2 with front face 9 and a hook 3 at one end. The hook is shaped to define a space 4 into which a rope light (not shown) can be securely held when the light holder 1 is hung on a gutter. Spiral end 6 extends from the opposite end of the body member 2, and has a proximal point 8 at some point on the curve. Proximal point 8 is adjacent body member 2, such that there is a space 7 between the inner curve of the spiral and outer curve of the spiral. The body 2 curves inward toward the spiral at a place 5 between the spiral 6 and the hook 3. As can be seen in FIG. 5, the tip of hook 3 approaches but does not touch the gutter 40. Maintaining a small space between the gutter and the top of the hook prevents scratching or chaffing of the gutter. The gutter has a lip 40 extending toward a rear wall. The front wall of the gutter has a flat portion 45 between the lip 46 and inwardly curving portion 41. When so positioned the rope lights create an illuminated gutter when the rope lights are on. The curved shape of the hook 3 will enable the hook to securely hold a rope light 51 in the upper curved portion 41 of a gutter 40 as shown in FIGS. 4 and 5. When held in this position adjacent a curved portion of the gutter direct sunlight will strike the rope lights only when the sun is at or below the 11:00 position, indicated by dotted line 60 in FIG. 5, and there are no adjacent structures that would block the light. In most urban locations this would correspond to a time period of only a few hours. Then the rope light is shielded by the gutter from direct sunlight for at least two-thirds of the daylight hours. The rope light can be easily inserted between the front face of the gutter and the space 4 defined by the hook end 3. Moreover, the rope light will be kept from being blown out of the hook by high winds.

Figure 2:
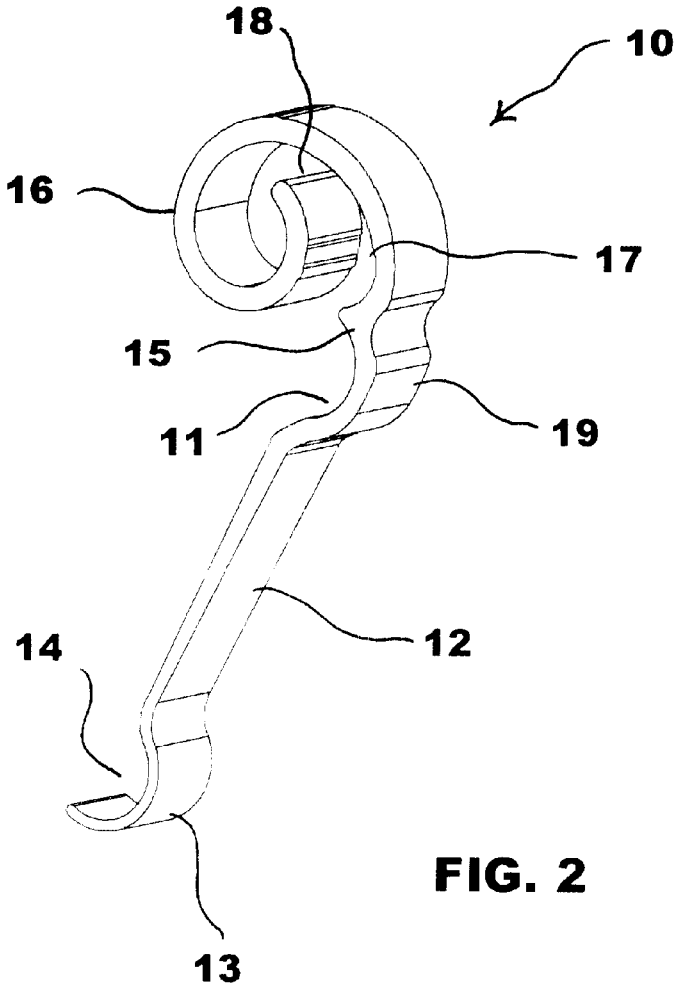
FIG. 2 is an perspective view of a second present preferred embodiment of my apparatus for hanging rope lights on a gutter.
Figure 6:
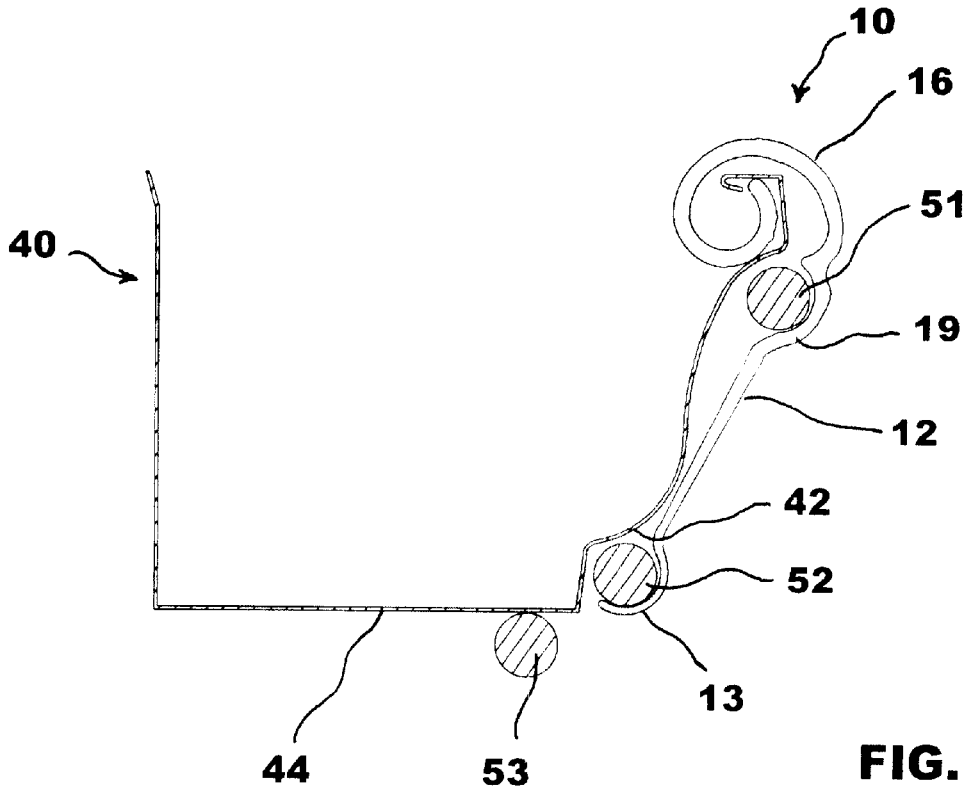
FIG. 6 is a sectional view taken along the line VI—VI in FIG. 4.

A second embodiment of the light holder 10, shown in FIGS. 2, 4 and 6, is configured to hold two separate and spaced apart strings of rope lights 51, 52. Like the first embodiment this light holder 10 has a flat body member 12 with a hook 13 at one end. The hook is shaped to define a first space 14 into which one rope light can be securely held when the light holder 10 is hung on a gutter. There is a second space 11 defined by curved portion 19. That second space is also sized to receive a rope light. Spiral end 16 extends from the opposite end of the body member 12 and has a proximal point 18 at some point on the curve. Proximal point 18 is adjacent body member 12 defining a space 17. The body 12 curves inward toward the spiral at a place 15. As can be seen in FIG. 6 this inwardly extending portion 15 will press against the front face of the gutter. Rope light 51 is held in the upper curved portion 41 of a gutter 40 by the curved portion 19 as shown in FIGS. 4 and 6. A second rope light 52 is held by hook 13 in the inwardly curved section 42 of the gutter 40 where the front of the gutter meets the bottom 44 of the gutter 40. If desired, the configuration of this embodiment could be changed so that a rope light could be held at inwardly curved section 42, but not at upper curved portion 44. Being nested in a curved section of the gutter the rope light 52 will be protected from high winds and shielded from direct sunlight during much of the day. The lights will also be protected by the curved portion of the gutter from water penetrating joints and plugs between sections.

Figure 7:
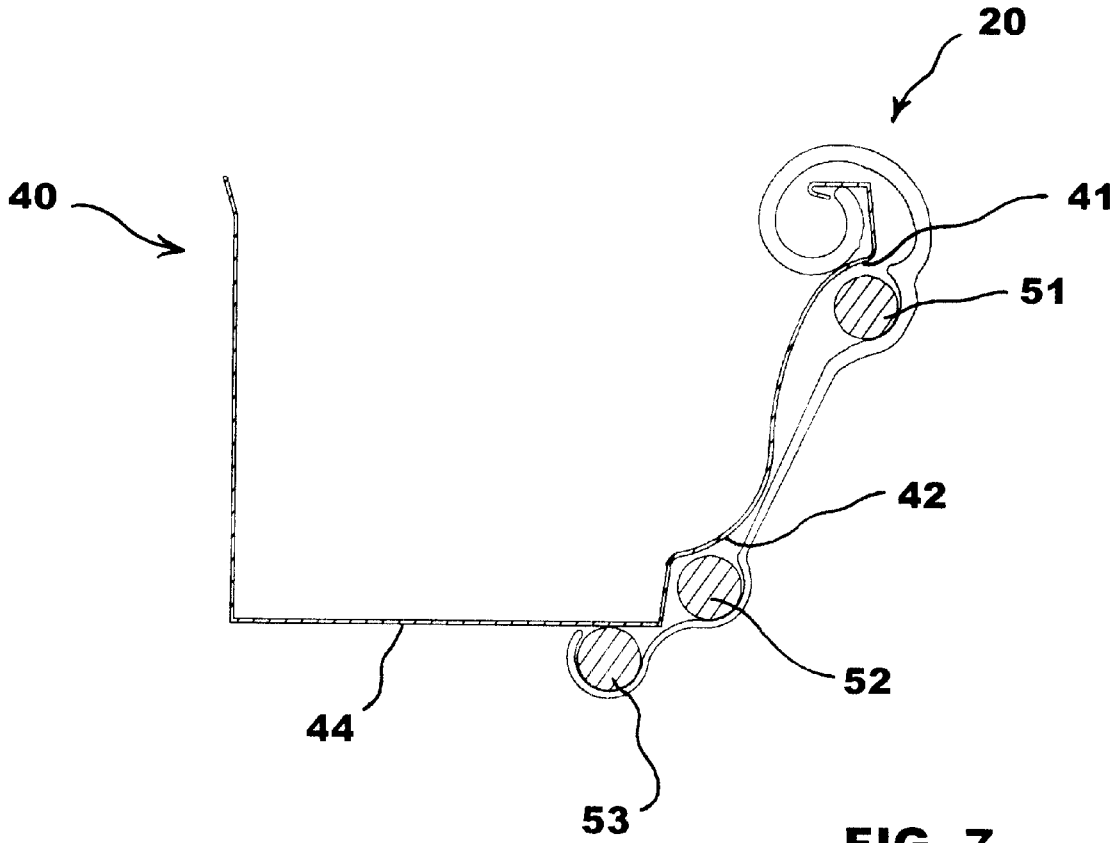
FIG. 7 is a sectional view taken along the line VII—VII in FIG. 4.

Retaining a rope light in a curved portion of a gutter such as curves 41 and 42 in FIGS. 5, 6 and 7 can result in the curved sections acting as reflectors with the light source located at the focus of the curve. This means more light from the rope light is directed toward a viewer in front of the light. Consequently, the rope light will look brighter than the same rope light on flat surface.

Figure 3:
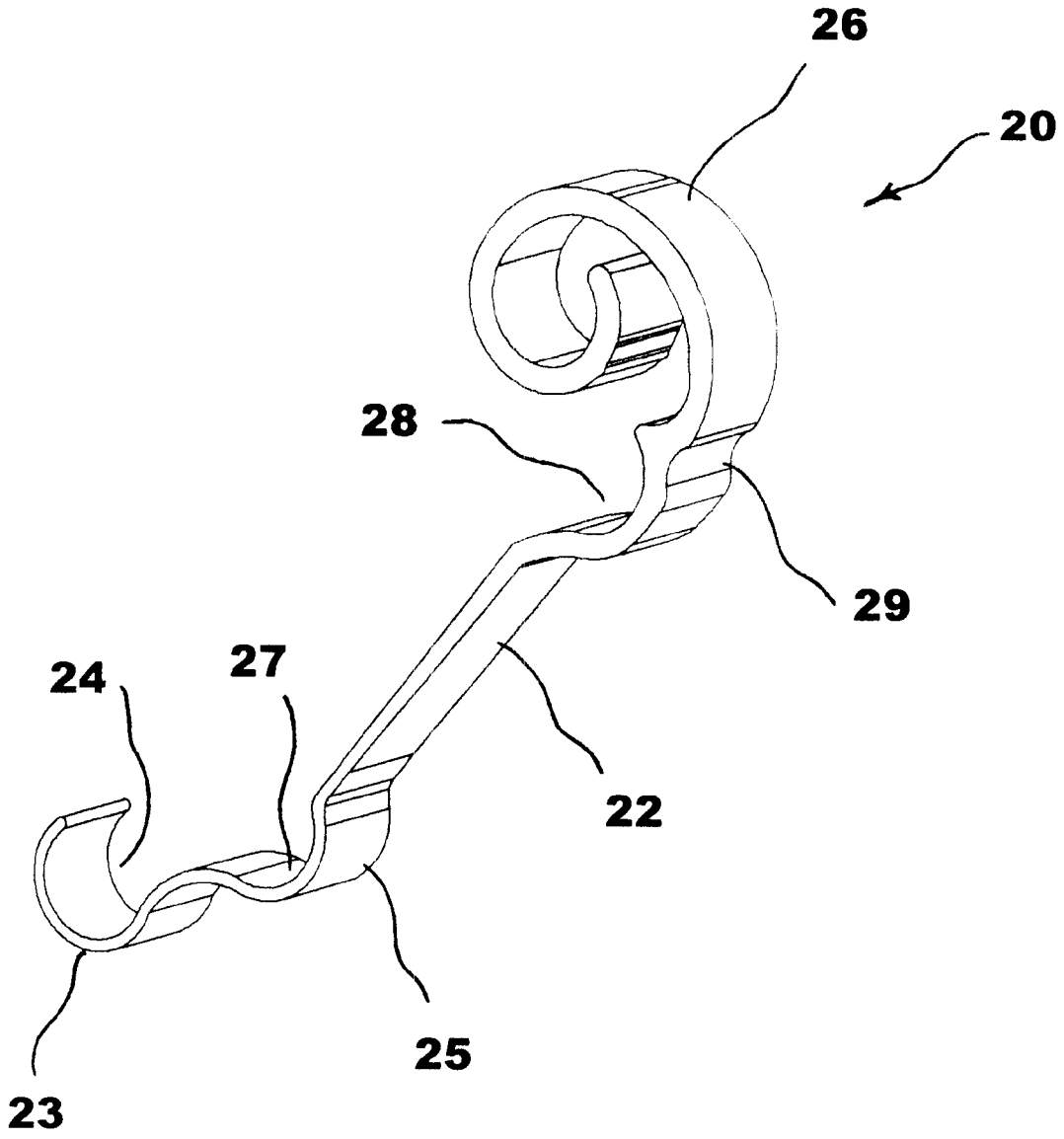
FIG. 3 is an perspective view of a third present preferred embodiment of my apparatus for hanging rope lights on a gutter.

A third present preferred embodiment 20, shown in FIGS. 3, 4 and 7, will support three rope lights 51, 52 and 53. This embodiment is similar to the previous two embodiments but is sized to extend under the bottom of the gutter. This embodiment also had an elongated ribbon-shaped body 22 with a spiral 26 at one end and a hook 23 at an opposite end. The hook 23 is shaped to define a first space 24 into which one rope light can be securely held when the light holder 10 is hung on a gutter. There is a second space 27 defined by curved portion 25, and a third space 28 defined by curved portion 29. Spaces 27 and 28 are also sized to receive a rope light 52 or rope light 51 as shown in FIGS. 4 and 7. Rope light 52 is held by curved portion 25 and the curved section 42 of the gutter 40 at the location where the front of the gutter meets the bottom of the gutter 44. Rope light 51 is held by curved portion 29 in space 28 at a location of the upper curved portion 41 of a gutter 40. The third rope light 53 is held by hook 23 under the bottom 44 of the gutter 40. In that portion rope light 51 is protected from winds and is not exposed to direct sunlight. The rope lights 51, 52 and 53 could be the same color or different colors. A patriotic display could be created with red, white and blue lights.

Because the rope lights are held tight against curved portions of the gutter by light holders 1, 10 and 20, they are less noticeable as well as protected. Therefore, the present apparatus for holding rope lights is particularly useful for those who would rather keep their rope lights up year round.

Figure 8:
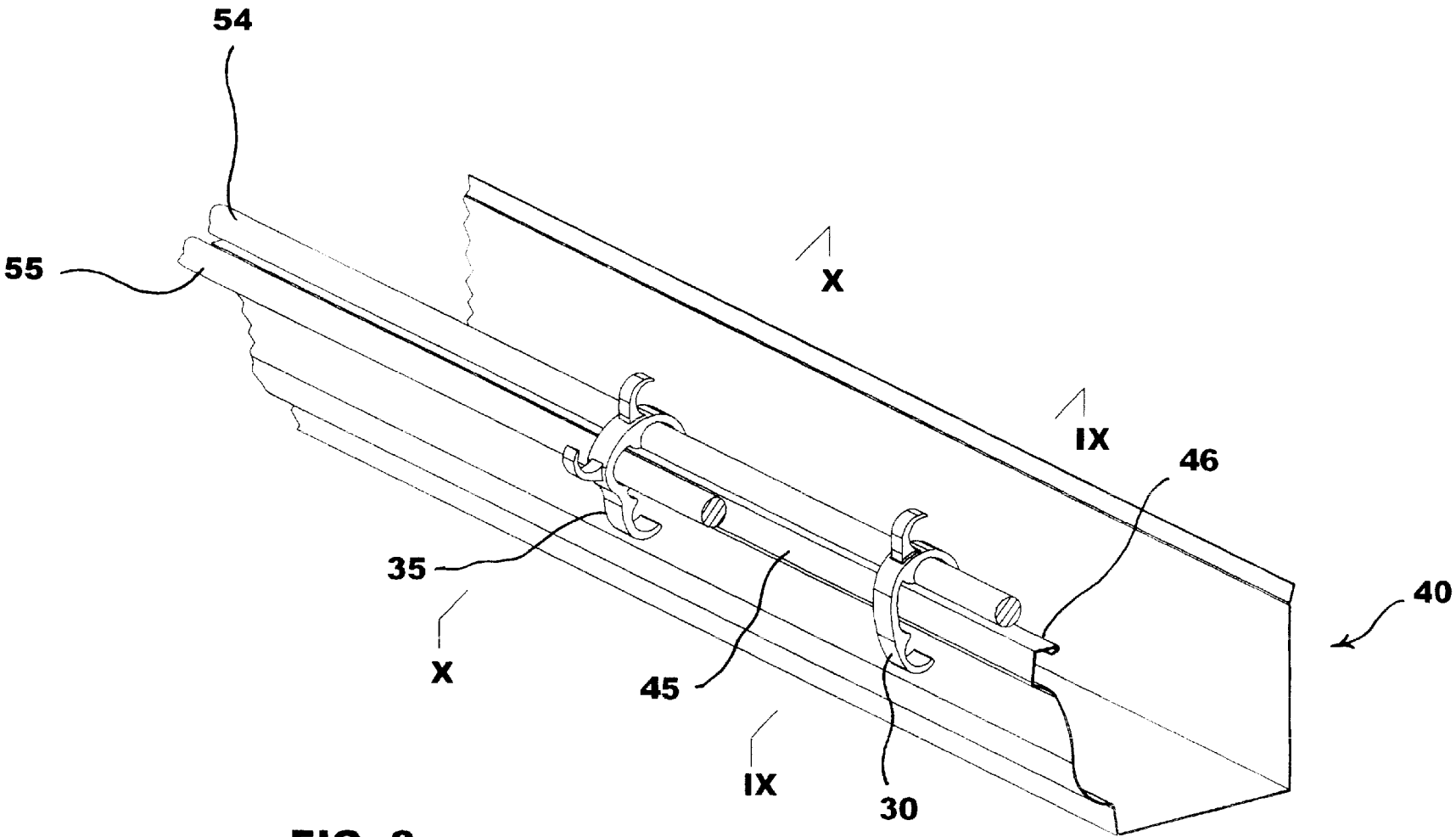
FIG. 8 is a perspective view of a portion of a gutter on which rope lights are being hung by one of each of the embodiments shown in FIGS. 9 and 10.
Figure 9:
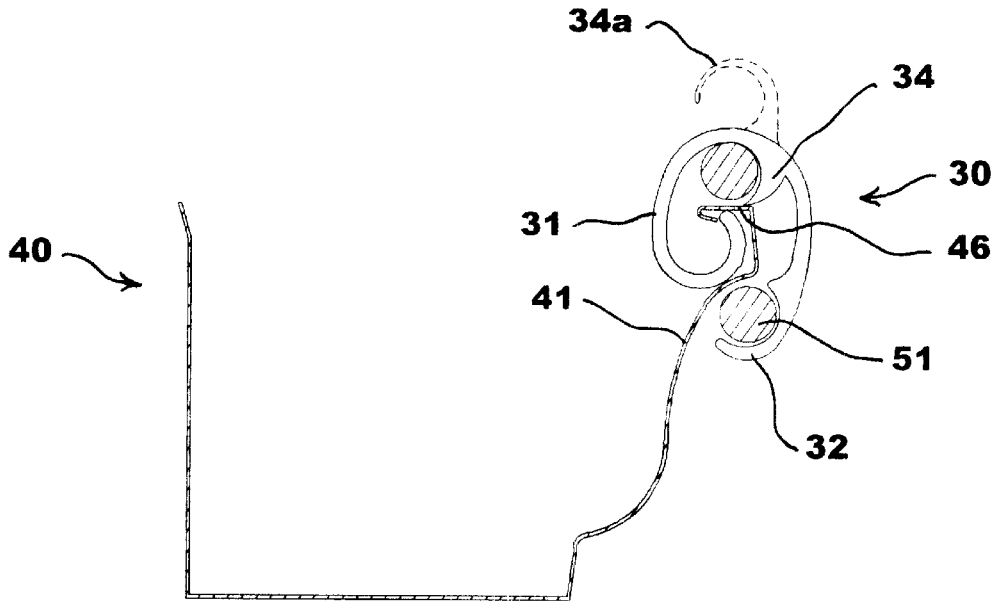
FIG. 9 is a sectional view taken along the line IX—IX in FIG. 8 showing a fourth present preferred embodiment of my light holder.
Figure 10:
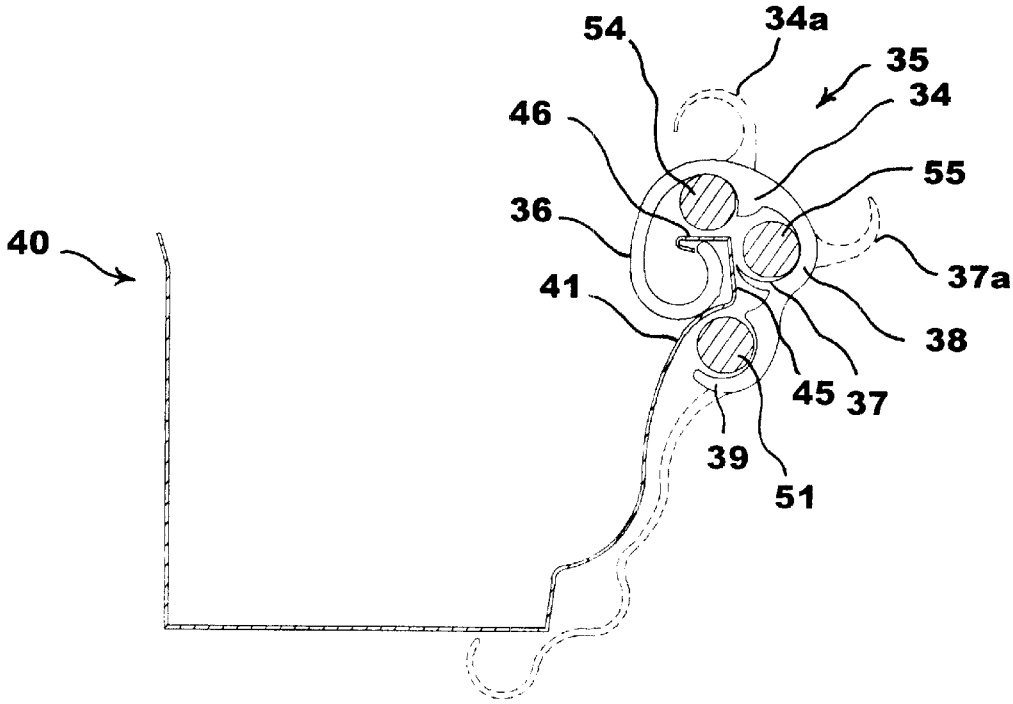
FIG. 10 is a sectional view taken along the line X—X in FIG. 8 fifth present preferred embodiment of my light holder.

While I prefer that the light holders position the rope lights in a curved portion of the gutter or under the gutter, some may prefer to mount the rope lights on top of the gutter or along the flat upper surface of the gutter. In FIGS. 8, 9 and 10 there is illustrated an embodiment 30 for hanging rope lights on top of the gutter and another embodiment 35 for hanging rope lights across the upper flat portion of the gutter. The fourth preferred embodiment 30 has a spiral end 31 that fits over the lip 46 of the gutter 40. A hook 34 extends from the spiral 31 to hold a rope light against the lip of the gutter. The hook 34 preferably abuts the lip of the gutter as shown to hold the rope light flat on the gutter. If desired the hook could be on the opposite face of the light holder as indicated by hook 34*a* shown in dotted line. The opposite end 32 of the light holder 30 may terminate adjacent the curved portion 41 of the gutter 40 as shown or extend further down the gutter as shown in dotted line. Thus, the light holder could have a shape similar to any of the previous embodiments 1, 10 and 20 with the addition of hook 34. One advantage of mounting rope lights above the gutter using the light holder shown in FIG. 9 is that the lip 46 of the gutter will prevent the rope light from sagging. A disadvantage is that the gutter would not protect the rope light from sunlight.

A fifth preferred embodiment 35 is similar to the fourth embodiment 30 but has a hook 37 located on the body 38 of the light holder below the spiral end 36. The hook 37 will support a rope light 55 against the flat portion 45 at the top of the gutter 40. If desired the hook could be on the opposite face of the light holder as indicated by hook 37*a* shown in dotted line. The end 39 of the light holder 30 may terminate adjacent the curved portion 41 of the gutter 40 as shown in FIG. 10 and hold a rope light 51, or extend further down the gutter as shown in dotted line. The light holder 35 may also have a hook 34 or hook 34*a* shown in dotted line for holding rope lights above the lip 46 of the gutter. This light holder could also have a shape similar to any of the previous embodiments.

Figure 11:
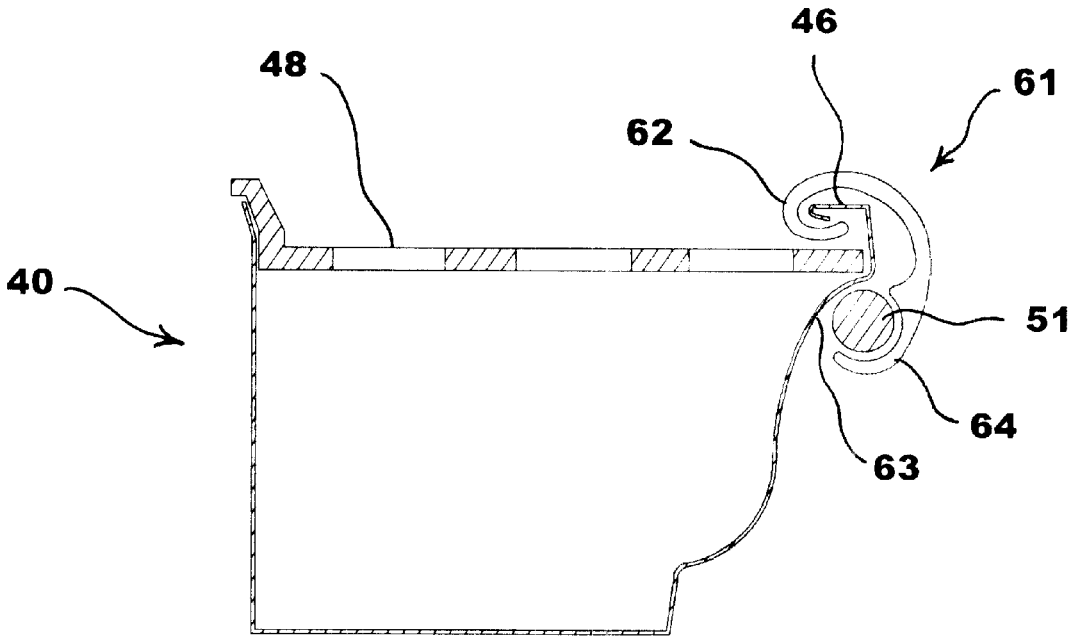
FIG. 11 is a sectional view similar to FIGS. 5, 6 and 7 showing a sixth present preferred embodiment of my light holder on a gutter in which a leaf guard is installed.

Sometimes gutters will have leaf guards. For these gutters it is preferable that The spiral portion have fewer curved sections. The embodiment of the light holder 61 shown in FIG. 11 is attached to a gutter 40 in which a leaf guard 48 has been placed. This light holder 61 has a spiral portion 62 that is much less curved than the light holders 1, 10 and 20 shown in FIGS. 1 through 7. While some might even consider this portion 62 of light holder 61 to be U-shaped, this shape is encompassed by the term spiral as used herein. As can be seen in FIG. 8, the end of the spiral portion 62 fits between the lip 46 of the gutter 40 and the leaf guard 48. The opposite end of this light holder 61 has a hook 64 that is shaped to hold rope light 51 in curve 63 of the gutter 40. If desired the spiral portion of light holders 1, 10 and 20 shown in FIGS. 5, 6 and 7 could be changed to be similar to spiral portion 62 of light holder 61.

Figure 12:
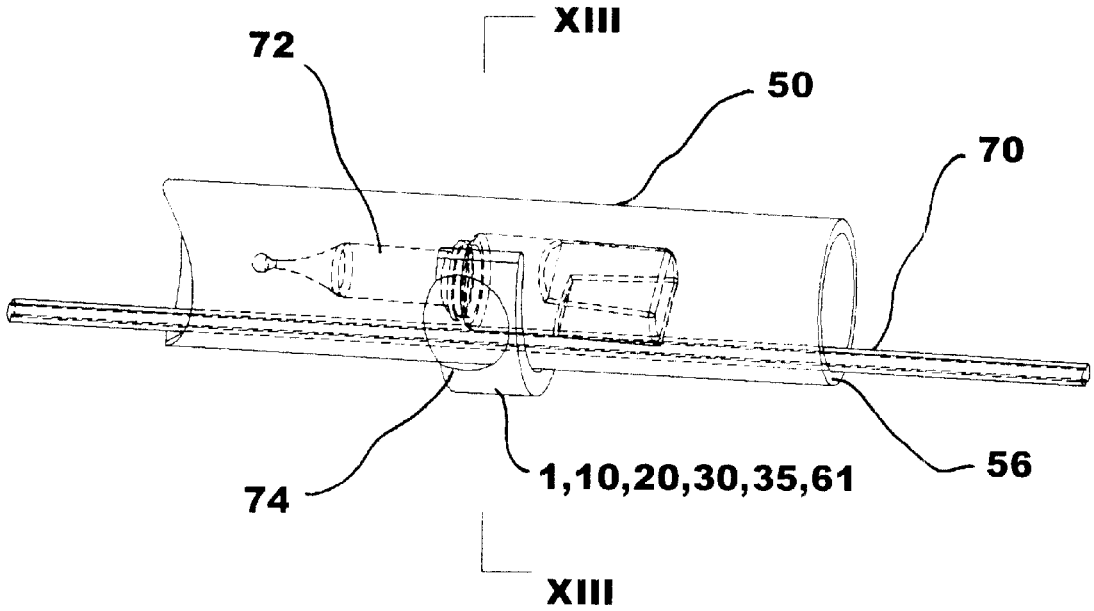
FIG. 12 is a fragmentary view of a portion of a rope light and a portion of any of the light holders which have been modified to contain a lens.
Figure 13:
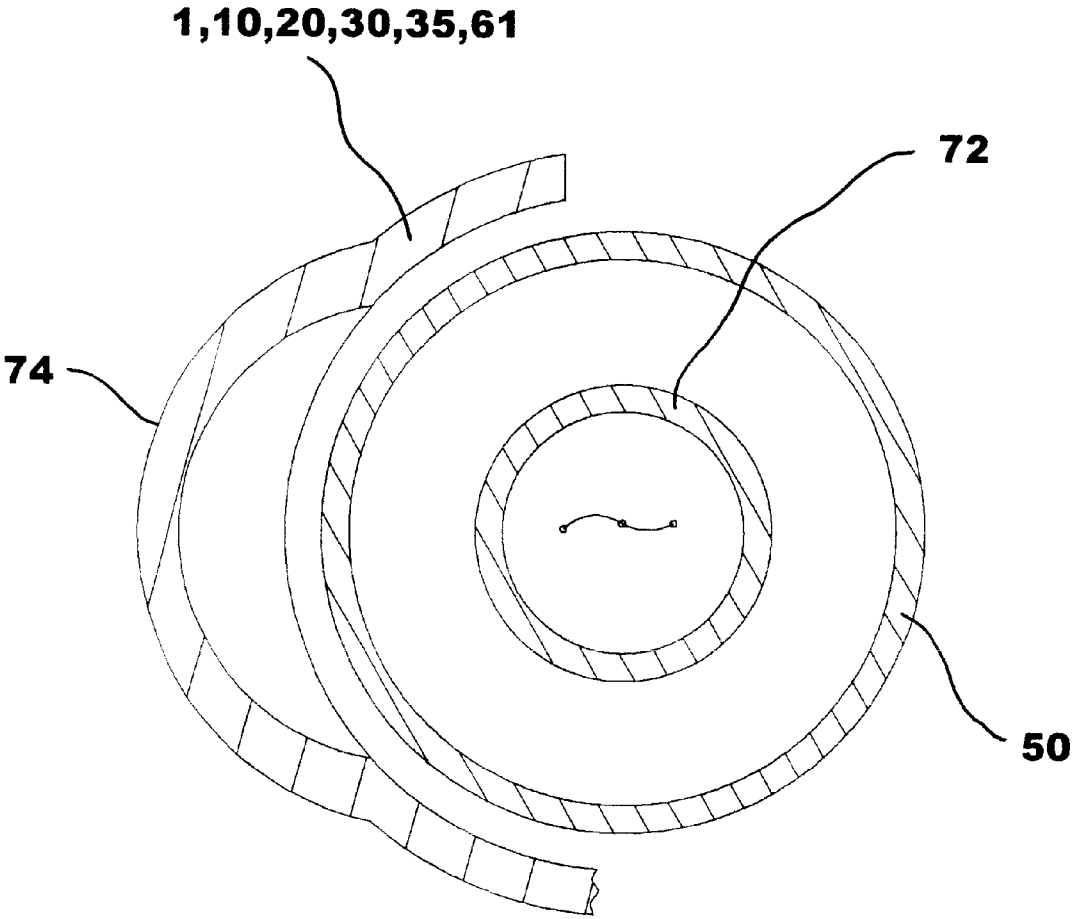
FIG. 13 is a sectional view taken along the line XIII—XIII in FIG. 12.

I prefer that the light holders 1, 10, 20, 30, 35 and 61 be molded from a clear plastic such as polycarbonate. A clear light holder is less noticeable and may not even be seen by a casual observer or an observer who is over 30 feet away. Furthermore, in a clear plastic light holder it is easy to mold a lens into the light holder as shown in FIGS. 12 and 13. Referring to those figures it can be seen that a rope light 50 has a tubular clear or translucent plastic sheath 56 through which i string of mini-lights 70 pass. The light bulbs 72 are usually spaced apart at regular intervals. Any of the light holders 1, 10, 20, 30, 35 and 61 could be molded to have a lens 74 in the body of the light holder or hook, The lens could be concave relative to the rope light as shown or convex. The lens could focus the light causing it to appear to be brighter or could direct the light to a particular point or region to maximize view effect.

While I have described a certain preferred embodiment of the invention, it is to be distinctly understood that the invention is not limited thereto but may be otherwise embodied and practiced within the scope of the following claims.

I claim:

1. A light holder for hanging rope lights on a gutter, the gutter of the type having a bottom, a front wall and a rear wall spaced apart from one another and extending from the bottom, and a lip extending from an upper edge of the top wall toward the rear wall, the front wall having a flat portion extending from the lip toward the bottom and an inwardly curving section adjacent the flat portion and opposite the lip, the light holder comprising:

an elongated body having a first end and a second end;

a gutter hook portion at the first end, the gutter hook portion sized to fit over the lip of the gutter; and a hook at the second end, the hook defining a space of sufficient size to receive a rope light;

wherein the elongated body and the hook are sized and configured so that when the gutter hook portion is over the lip of the gutter, the hook will be adjacent the inwardly curving section of the front wall of the gutter and open toward the front wall of the gutter.

2. The light holder of claim 1 wherein the holder is plastic.

3. The light holder of claim 2 wherein the plastic is a clear plastic.

4. The light holder of claim 2 also comprising a lens molded into the body.

5. The light holder of claim 1 also comprising a second hook attached to the gutter hook portion, the second hook defining a space of sufficient size to receive a rope light.

6. The light holder of claim 1 also comprising a third hook attached to the body, the third hook defining a space of sufficient size to receive a rope light, wherein the elongated body and the third hook are sized and configured so that when the gutter hook portion is over the lip of the gutter, the third hook will be adjacent the flat portion of the front wall of the gutter.

7. A light holder for hanging rope lights on a gutter, the gutter of the type having a bottom, a front wall and a rear wall spaced apart from one another and extending from the bottom, and a lip extending from an upper edge of the front wall toward the rear wall, the front wall having a flat portion extending from the lip toward the bottom and an inwardly curving section adjacent the flat portion opposite the lip and a shoulder adjacent a line where the front wall meets the bottom, the light holder comprising:

an elongated body having a first end, a second end and a curved portion between the first end and the second end, the curved portion defining a first space sized to receive a first rope light;

a gutter hook portion attached to the first end, the gutter hook portion sized to fit over the lip of the gutter; and a hook attached to the second end of the body, the hook defining a second space sized to receive a second rope light;

wherein the elongated body and hook are sized and configured so that when the gutter hook portion is over the lip of the gutter, the curved portion is adjacent the inwardly curving section of the gutter, and the hook is adjacent the shoulder of the gutter.

8. The light holder of claim 7 wherein the light holder is plastic.

9. The light holder of claim 8 wherein the plastic is a clear plastic.

10. The light holder of claim 8 also comprising a lens molded into the body.

11. The light holder of claim 7 also comprising a second hook attached to the gutter hook portion, the second hook defining a space of sufficient size to receive a rope light.

12. The light holder of claim 7 also comprising a third hook attached to the body, the third hook defining a space of sufficient size to receive a rope light, wherein the elongated body and the third hook are sized and configured so that when the gutter hook portion is over the lip of the gutter, the third hook will be adjacent the flat portion of the front wall of the gutter.

13. A light holder for hanging rope lights on a gutter, the gutter of the type having a bottom, a front wall and a rear wall spaced apart from one another and extending from the bottom, and a lip extending from an upper edge of the front wall toward the rear wall, the front wall having a flat portion extending from the lip toward the bottom and an inwardly curving section adjacent the flat portion opposite the lip and a shoulder adjacent a line where the front wall meets the bottom, the light holder comprising:

an elongated body having a first end, a second end, a first curved portion and a second curved portion, the curved portions being between the first end and the second end;

a gutter hook portion attached to the first end, the gutter hook portion sized to fit over the lip of the gutter; and a hook attached to the second end, the hook defining a space sized to receive a rope light;

wherein the elongated body and hook are sized and configured so that when the gutter hook portion is over the lip of the gutter:

i. the first curved portion of the body is adjacent the inwardly curving section of front wall and together with the inwardly curving section define a space of sufficient size to receive a rope light;

ii. the second curved section of the body is adjacent the shoulder of the gutter and together with the shoulder to define a second space of sufficient size to hold a rope light; and iii. the hook is under the bottom of the gutter.

14. The light holder of claim 13 wherein the holder is plastic.

15. The light holder of claim 14 wherein the plastic is a clear plastic.

16. The light holder of claim 14 also comprising a lens molded into the body.

17. The light holder of claim 13 also comprising a second hook attached to the gutter hook portion, the second hook defining a space of sufficient size to receive a rope light.

18. The light holder of claim 13 also comprising a third hook attached to the body, the third hook defining a space of sufficient size to receive a rope light, wherein the elongated body and the third hook are sized and configured so that when the gutter hook portion is over the lip of the gutter, the third hook will be adjacent the flat portion of the front wall of the gutter.

19. A light holder for hanging rope lights on a gutter, the gutter of the type having a bottom, a front wall and a rear wall spaced apart from one another and extending from the bottom, and a lip extending from an upper edge of the top wall toward the rear wall, the front wall having an inwardly curving section adjacent an intersection of the front wall and the bottom, the light holder comprising:

an elongated body having a first end and a second end;

a spiral portion at the first end, the spiral sized to fit over the lip of the gutter; and a hook at the second end, the hook defining a space of sufficient size and shape to receive and hold a rope light;

wherein the elongated body and the hook are sized and configured so that when the spiral portion is over the lip of the gutter, the hook will be adjacent the inwardly curving section of the front wall of the gutter and the space defined by the hook will be between the hook and the inwardly curving section.

20. The light holder of claim 19 wherein the light holder is plastic.

21. The light holder of claim 20 wherein the plastic is a clear plastic.

22. The light holder of claim 20 also comprising a lens molded into the body.

23. The light holder of claim 19 also comprising a second hook attached to the spiral portion, the hook defining a space of sufficient size to receive a rope light.

24. The light holder of claim 19 also comprising a third hook attached to the body, the third hook defining a space of sufficient size to receive a rope light, wherein the elongated body and the third hook are sized and configured so that when the spiral portion is over the lip of the gutter, the hook will be adjacent the flat portion of the front wall of the gutter.

25. A light holder for hanging rope lights on a gutter, the gutter of the type having a bottom, a front wall and a rear wall spaced apart from one another and extending from the bottom, and a lip extending from an upper edge of the top wall toward the rear wall, the front wall having a flat portion extending from the lip toward the bottom and an inwardly curving section adjacent the flat portion and opposite the lip, the holder comprising:

an elongated body having a first end and a second end;

a gutter hook portion at the first end, the gutter hook portion sized to fit over the lip of the gutter; and a hook attached to the gutter hook portion, the hook defining a space of sufficient size to receive a rope light.

26. The light holder of claim 25 wherein the light holder is plastic.

27. The light holder of claim 26 wherein the plastic is a clear plastic.

28. The light holder of claim 26 also comprising a lens molded into the body.

29. A light holder for hanging rope lights on a gutter, the gutter of the type having a bottom, a front wall and a rear wall spaced apart from one another and extending from the bottom, and a lip extending from an upper edge of the top wall toward the rear wall, the front wall having a flat portion extending from the lip toward the bottom and an inwardly curving section adjacent the flat portion and opposite the lip, the light holder comprising:

an elongated body having a first end and a second end;

a gutter hook portion at the first end, the gutter hook portion sized to fit over the lip of the gutter; and a hook attached to the elongated body wherein the elongated body and the hook are sized and configured so that when the gutter hook portion is over the lip of the gutter, the hook will be adjacent the flat portion of the front wall of the gutter, the hook being configured to hold a rope light against said flat portion.

30. The light holder of claim 29 wherein the light holder is plastic.

31. The light holder of claim 30 wherein the plastic is a clear plastic.

32. The light holder of claim 30 also comprising a lens molded into the body.

33. An illuminated gutter display comprising:

a gutter having a front wall and a bottom, such that there is a curved portion being on the front wall at a location where the front wall meets the bottom;

a rope light positioned adjacent the curved portion of the gutter; and a plurality of light holders, each light holder attached to the gutter and the rope light, the hooks sized and configured to retain the rope light adjacent the curved portion.

34. The illuminated gutter display of claim 33 wherein the curved portion is shaped and the rope light is positioned so that light from the rope light will be reflected from the curved portion toward a viewer who is a selected distance from the gutter.

35. The illuminated gutter display of claim 34 wherein the curved portion has a focus and the rope light is at that focus.

36. The illuminated gutter display of claim 33 wherein the curved portion is shaped and the rope light is positioned so that the gutter shields the rope light from direct sunlight during at least two thirds of a daily period of daylight.

37. The illuminated gutter display of claim 33 wherein the curved portion is shaped and the rope light is positioned so that the gutter inhibits water from penetrating joints and plugs between sections of the rope light.

38. The illuminated gutter display of claim 33 wherein the light holders are plastic.

39. The illuminated gutter display of claim 38 wherein the plastic is a clear plastic.

* * * * *